US008893334B1

(12) United States Patent
Wong

(10) Patent No.: US 8,893,334 B1
(45) Date of Patent: Nov. 25, 2014

(54) ORTHOPEDIC PILLOWS

(71) Applicant: Danny C. Wong, San Gabriel, CA (US)

(72) Inventor: Danny C. Wong, San Gabriel, CA (US)

( * ) Notice: Subject to any disclaimer, the term of this patent is extended or adjusted under 35 U.S.C. 154(b) by 0 days.

(21) Appl. No.: 13/744,735

(22) Filed: Jan. 18, 2013

(51) Int. Cl.
*A47C 20/00* (2006.01)
*A47G 9/10* (2006.01)

(52) U.S. Cl.
CPC ..... *A47G 9/109* (2013.01)
USPC ..... 5/640; 5/622; 5/636; 5/637; 5/638; 5/655.9

(58) Field of Classification Search
USPC ..... 5/636, 630, 637, 638, 652, 655.9, 622, 5/640
See application file for complete search history.

(56) References Cited

U.S. PATENT DOCUMENTS

D271,834 S * 12/1983 Huntsinger ..... D6/601
4,850,067 A * 7/1989 Latorre ..... 5/636
5,214,814 A * 6/1993 Eremita et al. ..... 5/636
5,457,832 A * 10/1995 Tatum ..... 5/636
5,505,518 A * 4/1996 Pike ..... 297/242
6,381,784 B1 * 5/2002 Davis et al. ..... 5/636
6,574,809 B1 * 6/2003 Rathbun ..... 5/636
6,671,906 B1 * 1/2004 Milligan ..... 5/636
6,981,288 B1 * 1/2006 Hu ..... 5/636
6,993,800 B2 * 2/2006 Greenawalt et al. ..... 5/636
7,856,687 B2 * 12/2010 Chou ..... 5/640
7,992,241 B2 * 8/2011 Davis, III ..... 5/655.3
2005/0050636 A1 * 3/2005 Setokawa ..... 5/636
2005/0262637 A1 * 12/2005 Funatogawa ..... 5/636
2008/0028528 A1 * 2/2008 Wilson ..... 5/636
2010/0175193 A1 * 7/2010 Oh et al. ..... 5/638
2012/0079660 A1 * 4/2012 Chen ..... 5/644

* cited by examiner

*Primary Examiner* — William Kelleher
*Assistant Examiner* — Duoni Pan
(74) *Attorney, Agent, or Firm* — Che-Jang Chen; Law Office of Michael Chen

(57) ABSTRACT

A pillow in the present invention may include a main pillow body and a neck support. The main pillow body may include three sections: a head support section and a pair of lateral support sections; and the shape of the main pillow body resembles a reverse letter "U." In an exemplary embodiment, each lateral support section extends from the main pillow body with an enlarging rear end, and the length of lateral support sections is designed to be slightly longer than conventional pillows, so that the pillow would be long and wide enough to support the user's shoulders, no matter which rest position the user adopts. Also, the rear ends of the lateral support sections are thicker by inserting more stuffing materials inside to provide better lateral support to the user when he/she rests on the side during sleep.

12 Claims, 8 Drawing Sheets

ORTHOPEDIC PILLOWS

FIELD OF THE INVENTION

The present invention relates to a pillows, and more particularly to pillows that provide ideal support to the user no matter which rest position he/she adopts.

BACKGROUND OF THE INVENTION

Averagely, every person spends one third of his/her lifetime in sleep to recover from the day's exertions and to prepare for the next day's activities. A quality sleep is very important not only to rest the individual's body, but also to enhance the individual's health, and a good pillow that provides proper support to the sleeper is definitely a major factor contributing to the quality sleep. Traditional pillows may provide certain level of head and neck support, but the support may be insufficient and may cause sleeping problems. Deficient support during sleep may give rise to headache, neck pain, back pain and other discomforts of a muscular nature. The pain and tension may further generate sleeping problems, such as increased perspiration during rest, insomnia, restlessness, light sleep, and snoring.

It is known that the human cervical spine is not straight, but forms a lordotic curvature due to the trapezoidal profile of the neck vertebrae. The seven vertebrae of the cervical area of the spine, which are linked through six mobile connections to produce a moderate curve. The optimal position of the human cervical spine is known as the neutral position corresponding to the most anatomically natural position of the cervical spine of a person who is standing upright with correct posture. In the neutral position, the lordotic curve of the cervical spine is maintained such that the lowest degree of stress is placed on the cervical vertebrae and surrounding connective and other tissues to minimize the neck and back pain. Recently, some orthopedic pillows have been developed to provide better supports of a human cervical spine and head with respect to several different rest positions.

U.S. Pat. No. 6,345,401 to Frydman discloses an orthopedic pillow having a contoured top layer, a plurality of supporting layers, each having tongue-and-groove structures to enable the contoured layer to be removably supported by one or more additional supporting layers, as shown in FIG. 1. The orthopedic support pillow that can be customized in terms of height in order to fit an individual's needs and/or preferences without the use of accessory devices such as hook-and-loop, elastic bands, zippers and straps. Also, Frydman's pillow can provide support for the natural contour of the cervical lordosis. Even though the pillow disclosed by Frydman provides head and neck support, the contoured top layer may not be a proper surface to provide shoulder and cheek support to the user.

U.S. Pat. No. 7,707,668 to Kloes, et al. discloses a pillow for relieving pressure on a neck of a user. The pillow includes a body section, a first lobe member integrally bound to the body section and adaptable for supporting a nape of a neck of a user, and a second lobe member integrally bound to the body section and adaptable for supporting a cheek bone and a jaw of the user. The pillow also includes a channel formed in the body section between the first lobe member and the second lobe member, wherein the channel is adaptable for receiving the neck of the user to relieve pressure on the neck of the user, as shown in FIG. 2. Even though Kloes indicates that the pillow may provide support to the user's cheek bone and jaw, the support may be improper due to the arrangement of the channel and lobes, and the shape of the pillow.

U.S. Pat. No. 8,015,640 to Sun discloses an improved multi-position cervical pillow which alone can provide four unique positions, and a novel pillow set thereof with an additional, unattached ancillary pillow pad. The simple construction of the pillow set with a simple adjusting method from the present invention will provide the user an easy control and yield virtually unlimited options for the user to customize the pillow set for his/her personal comfort. However, like Frydman and Kloes, the pillow configuration disclosed by Sun may provide good support of the user's neck and head, but not the user's shoulders and cheeks.

Therefore, there remains a need for a new and improved pillow to provide complete and thorough support for the user to overcome the problems addressed above during sleep and further enhance the user's quality of sleep.

SUMMARY OF THE INVENTION

It is an object of the present invention to provide an orthopedic pillow that is able to provide complete support to the user's neck, head, shoulders and cheeks to reduce discomfort and even pain during sleep, and further eliminate sleeping problems generated therefrom.

It is another further object of the present invention to provide a pillow having elongated lateral support sections with enlarged and thicker rear ends to provide proper and sufficient support to the user's shoulders and cheeks.

It is still another object of the present invention to provide a pillow having a main pillow body and a neck support that are separable.

It is a further object of the present invention that the user can adjust the height or thickness of the pillow by inserting or reducing the amount of stuffing materials therein.

In one aspect, a pillow in the present invention may include a main pillow body and a neck support. The main pillow body may include three sections: a head support section and a pair of lateral support sections; and the shape of the main pillow body resembles a reverse letter "U," and the neck support can be disposed at the opening of the reverse U-shaped main pillow body.

In one embodiment, the head support section is at the central portion of the main pillow body to provide support to the user's head, while the lateral support sections are located on both sides of the head support section to provide support to the user's shoulders and cheek. The neck support may be separable from the main pillow body, and it can be attached to the main pillow body by touch fastener, buttons, or any other mechanism which can serve the same purpose. In another embodiment, the head support section has an extended portion to connect the neck support section, and the extended portion is slightly sloped to support the back side of the user's head, namely the occipital bone.

In still another embodiment, the pillow may use any suitable stuffing material including down, fiberfill, feathers, granular materials, polyurethane foam, or the like. In a further embodiment, the user can adjust the height or thickness of either the main pillow body or neck support by adjusting the amount of stuffing material inserted therein.

In still a further embodiment, the neck support can be the shape of "tear drop," which can provide better support to the neck to create and promote the natural lordotic curve of the neck; prevents deformity when using polyfills; and disperses the weight of compression when using memory foam material. Also, It can be easily and tightly attached to the head support section and extended portion due to its special shape.

In an exemplary embodiment, each lateral support section extends from the main pillow body with an enlarging rear end, and the length of lateral support sections is designed to be slightly longer than conventional pillows, so that the pillow would be long and wide enough to support the user's shoulders, no matter which rest position the user adopts.

In still an exemplary embodiment, the rear ends of the lateral support sections are thicker by inserting more stuffing materials inside to provide better lateral support to the user when he/she rests on the side during sleep. More particularly, the enlarged and thicker rear ends of the lateral support sections are used to provide proper support to the cheeks of the user and create an ideal sleeping surface of the pillow to maximize the user's comfort level.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

As discussed above, a good pillow may significantly contribute to a quality sleep, which is very important not only to rest an individual's body, but also to enhance the individual's health. Traditional pillows may provide certain level of head and neck support, but the support may be insufficient and cause sleeping problems. Furthermore, traditional pillows do not usually provide proper shoulder and cheek support. Therefore, a new and improved pillow that is able to provide complete support to cover "six points" on the individual's body including neck, head, shoulders and cheeks is needed.

Figure 1:
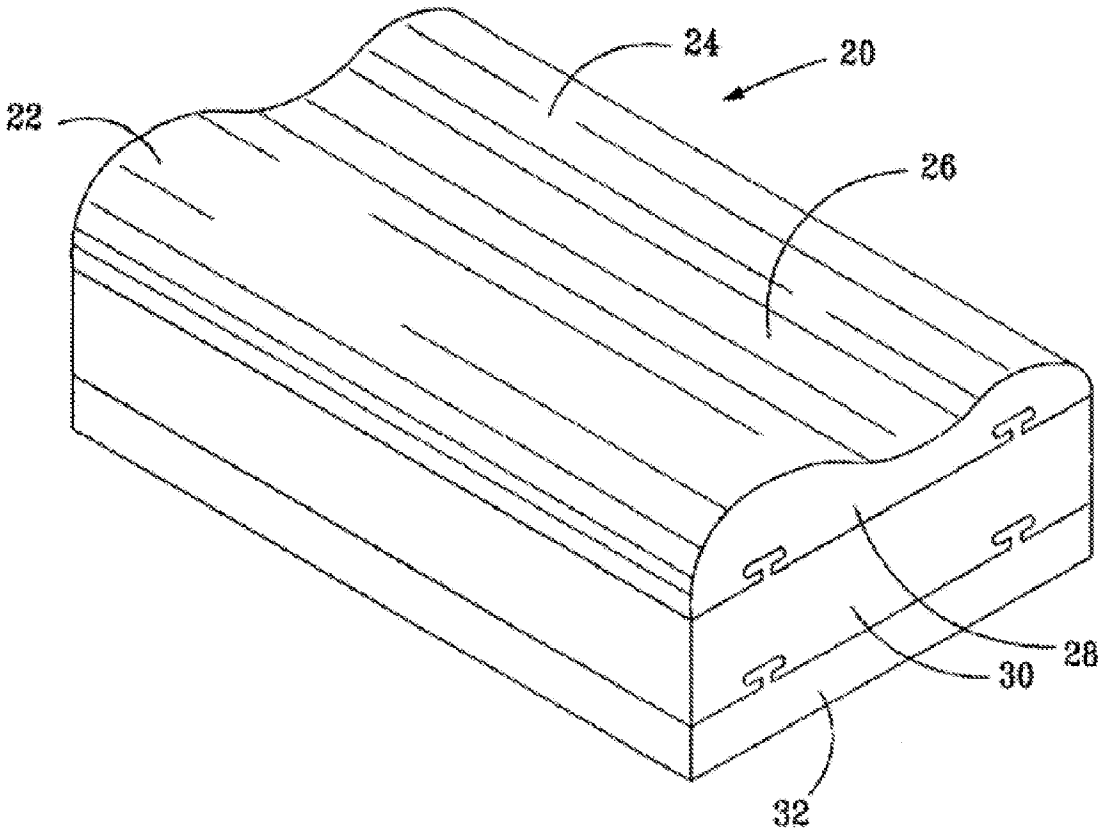
FIG. 1 (Prior art)
FIG. 1 is a prior art illustrating an orthopedic support pillow that can be customized in terms of height in order to fit an individual's needs and/or preferences without the use of accessory devices.
Figure 2:
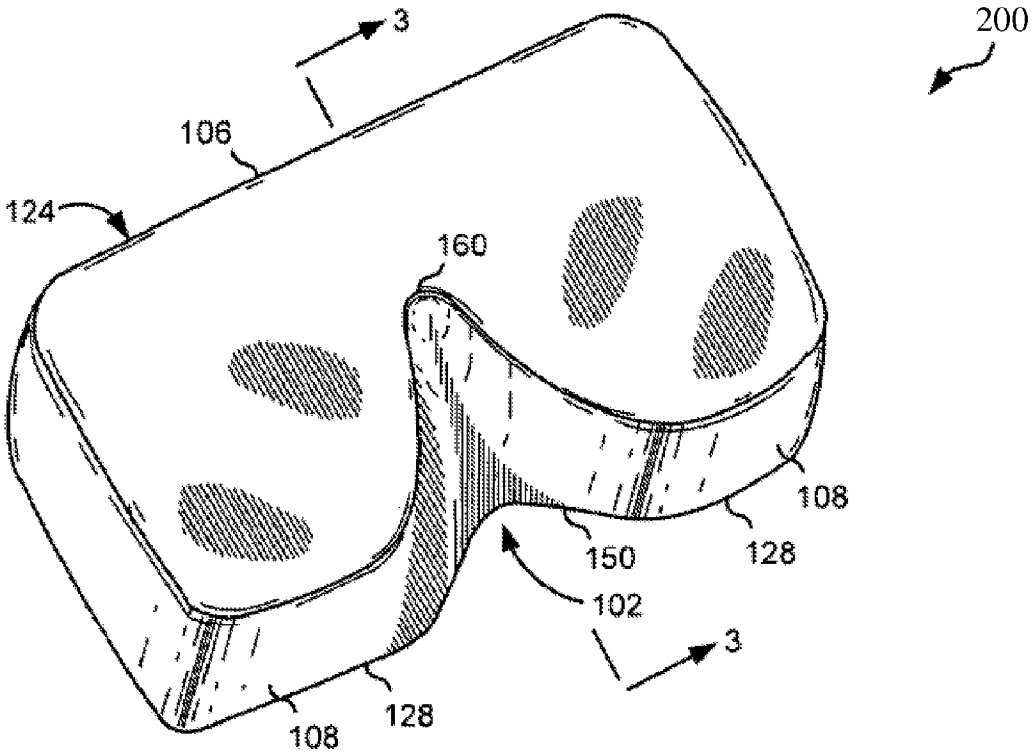
FIG. 2 (Prior art)
FIG. 2 is a prior art illustrating a pillow for relieving pressure on a neck of a user.
Figure 3:
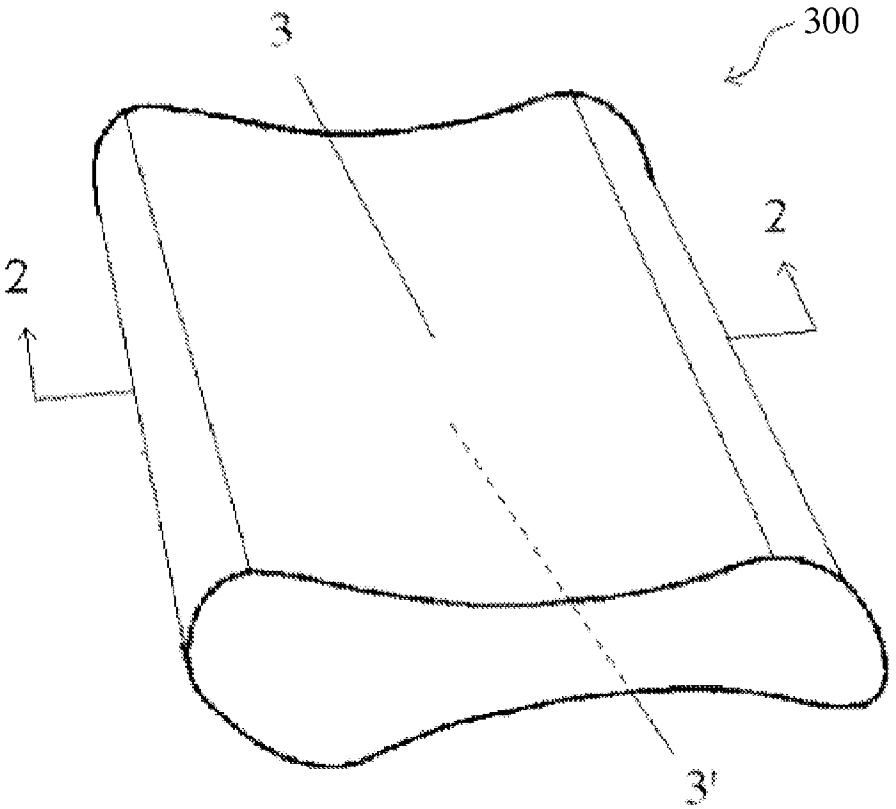
FIG. 3 (Prior art)
FIG. 3 is a prior art illustrating an improved multi-position cervical pillow which alone can provide four unique positions, and a novel pillow set thereof with an additional, unattached ancillary pillow pad.
Figure 4:
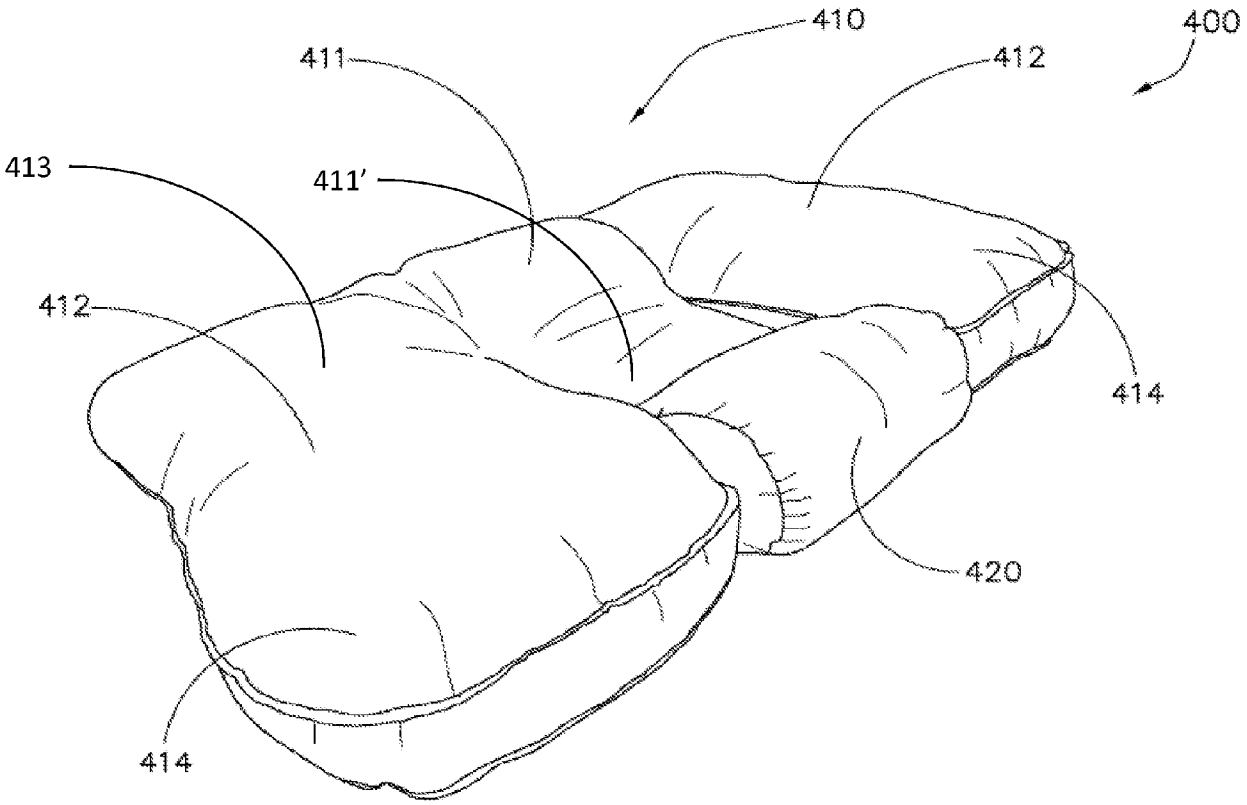
FIG. 4 illustrates a pillow having a main pillow body and a neck support in the present invention, and the main pillow body and the neck support are connected.
Figure 4A:
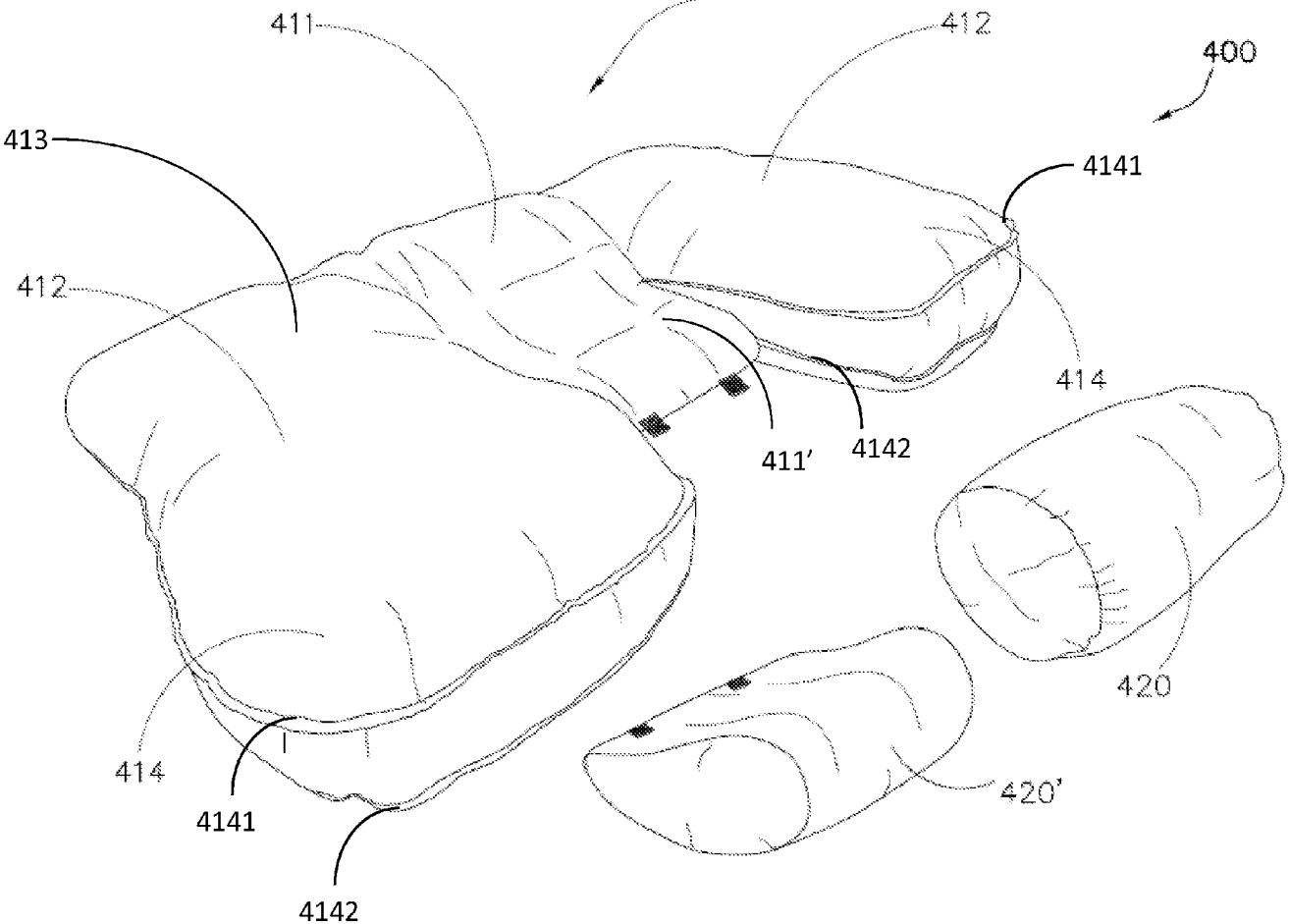
FIG. 4*a* illustrates a pillow having a main pillow body and a neck support in the present invention, and the main pillow body and the neck support are separated.

In one aspect as shown in FIGS. 4 and 4*a*, a pillow 400 may include a main pillow body 410 and a neck support 420. The main pillow body 410 may include three sections: a head support section 411 and a pair of lateral support sections 412. The shape of the main pillow body 410 resembles a reverse letter "U," and the neck support can be disposed at the opening of the reverse letter U. In one embodiment, the head support section 411 is at nearly the central portion of the main pillow body 410 to provide support to the user's head, while the lateral support sections 412 extends from both sides of the head support section 411 to provide support to the user's shoulders and cheeks. The head support section 411 may have an extended portion 411' to connect the neck support section 420, and the extended portion 411' is slightly sloped (so called "sand beach" shape) to support the back side of the user's head, namely the occipital bone. In another embodiment, the neck support 420 may be separable from the main pillow body 410, and it can be attached to the main pillow body 410 by touch fastener, buttons, or any other mechanism which can serve the same purpose. Still referring to FIG. 4*a* for a further embodiment, the neck support can be the shape of "tear drop," which is able to provide better support to the individual's neck to create and promote the natural lordotic curve of the neck. Also, it prevents deformity when using polyfills and disperses the weight of compression when using memory foam material. Furthermore, it can be easily and tightly attached to the head support section 411 and extended portion 411' due to its special shape. The pillow 400 may use any suitable stuffing material including down, fiberfill, feathers, granular materials, polyurethane foam, or the like. In a further embodiment, the user can adjust the height or thickness of either the main pillow body 410 or neck support 420 by adjusting the amount of stuffing material inserted therein.

Figure 4B:
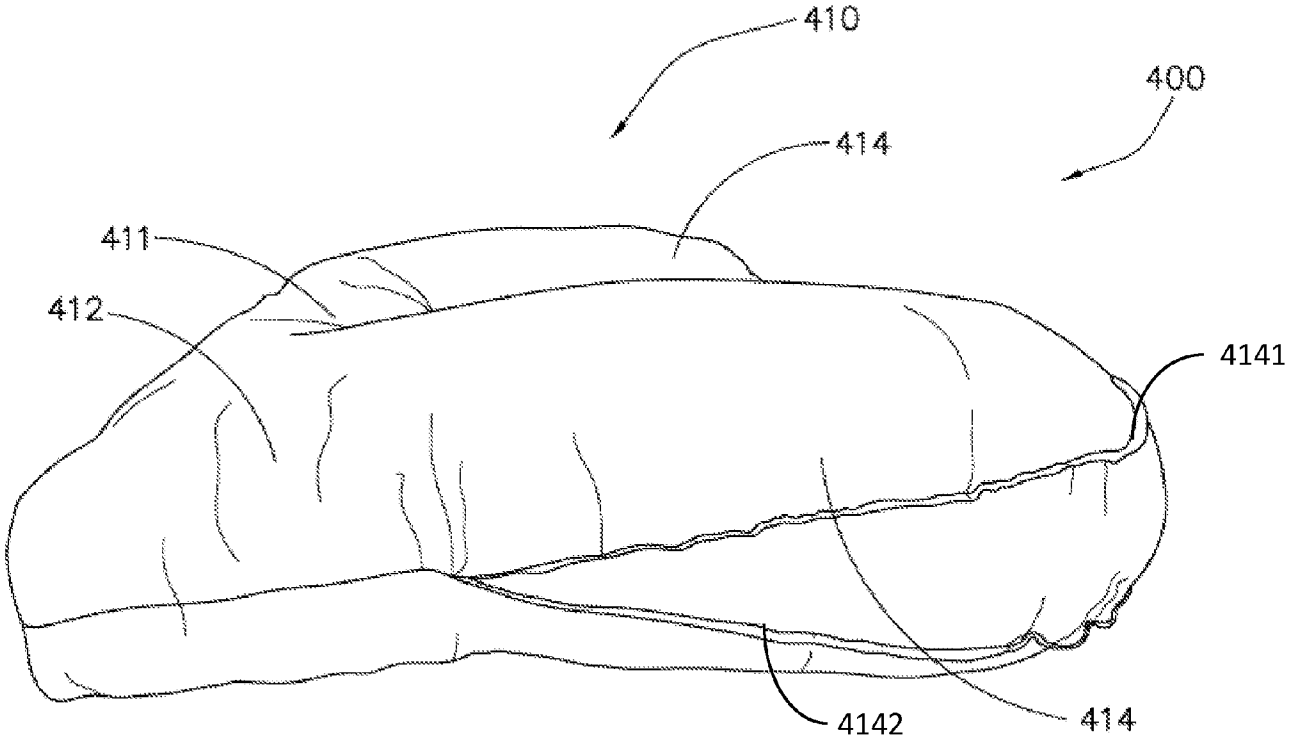
FIG. 4*b* shows a lateral view of the pillow in the present invention.

Referring to FIGS. 4, 4*a* and 4*b*, each lateral support section 412 extends from the main pillow body 410 having a connecting end 413 connecting to the head support section 411 and an enlarging rear end 414, and the length/width of lateral support sections 412 is designed to be longer/wider than conventional pillows, so that the pillow 400 would be long and wide enough to support the user's shoulders, no matter which rest position the user adopts. It is noted that since the enlarging end 414 is wider and thicker than the connecting end 413 of the lateral support section 412, the stuffing material cannot be easily moved toward the connecting end 413, so the enlarging end 414 can continue to provide better shoulder and cheek support to the user. It is also noted that each of the enlarging end 414 has a first edge 4141 and a second edge 4142 which are connected on an outer portion of the enlarging end 414, gradually separated to extend around the enlarging end 414 respectively, and ended at different positions on an inner portion of the enlarging end 414.

Currently, most conventional orthopedic pillows focus on neck, head and back support when the user rests in a back sleeping position, however, those orthopedic pillows may not provide proper lateral support, which may cause the muscles to compensate, and the muscle tension will not allow the body to be fully relaxed during sleep. Thus, when the user turns on the side during sleep, he/she may experience certain level of discomfort or even pain due to improper lateral support of the pillow. In an exemplary embodiment shown in FIGS. 4*a* and 4*b*, the rear ends 414 of the lateral support sections 412 are thicker by inserting more stuffing materials inside to provide better lateral support to the user when he/she rests on the side during sleep. More particularly, since the enlarging end 414 is wider and thicker than the connecting end 413, the stuffing material is difficult to move toward the connecting end 413, so the enlarged and thicker rear ends 414 of the lateral support sections 412 would provide better support to the cheeks of the user and create an ideal sleeping surface of the pillow to maximize the user's comfort level. According to the results of medical researches, good cheek support (namely temporal bone support) would effectively prevent torticollis.

Figure 4C:
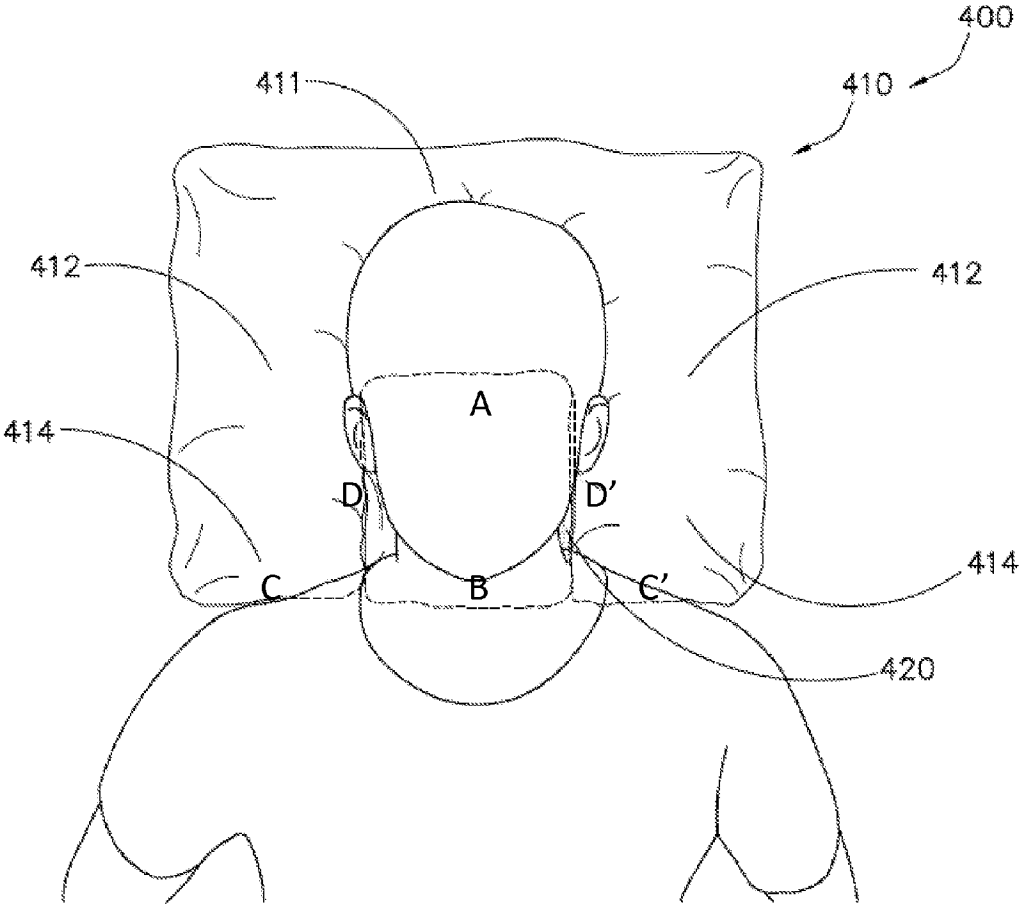
FIG. 4*c* illustrates the pillow in the present invention providing a "six point" support including head, neck, shoulder and cheek support.
Figure 4D:
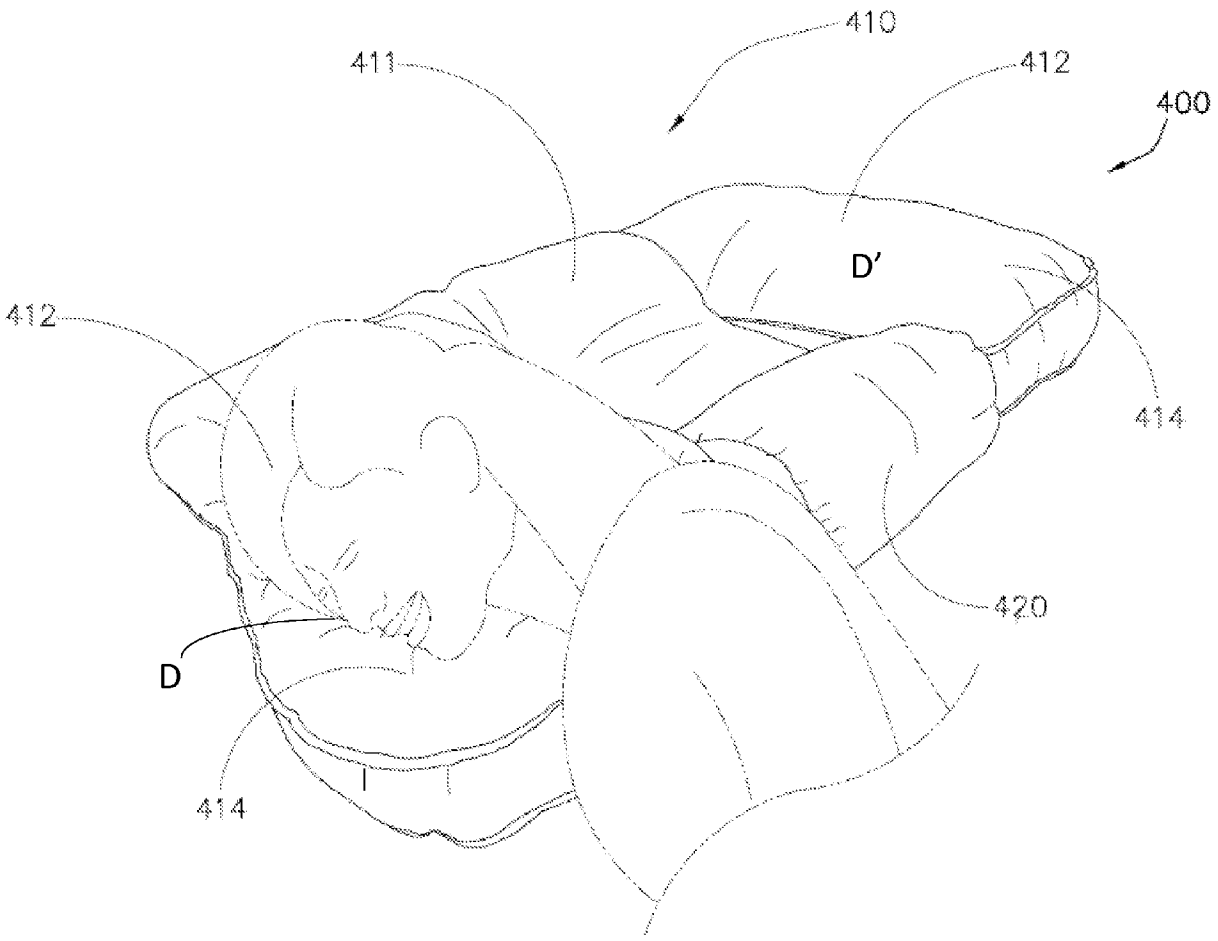
FIG. 4*d* illustrates the pillow in the present invention providing cheek and shoulder support.

Referring to FIG. 4*c*, when the user's rest position is supine, the pillow 400 is adapted to provide support to the user at least in the positions including head (A), neck (B), shoulders (C, C') and cheeks (D, D'). More particularly, the head support section 411 of the pillow 400 provides head support to the user, while the neck support 420 provides proper neck support. It is noted that the user can adjust the head support section 411 and the neck support 420 by simply inserting or reducing the stuffing material therein. Furthermore, the elongated lateral support sections 412, extending from the head support section 411, are configured to provide sufficient shoulder and cheek support to the user. The length of the lateral support section 412 is also adjustable to cover the user's shoulders, and the user can adjust the height or thickness of the lateral support section 412 as well by simply inserting or reducing the stuffing material therein. Also, the enlarged and thicker rear ends 414 of the lateral support sections 412 would provide appropriate cheek support (D, D') to the user to prevent the user's head from tilting laterally. Likewise, when the user rests on one side, the rear ends 414 of the lateral support sections 412 provide cheek support (D, D') to the user, as shown in FIG. 4*d*. More specifically, the enlarged and thicker rear ends 414 of the lateral support sections 412 are used to provide proper and sufficient support to the cheeks of the user and create an ideal sleeping surface of the pillow to maximize the user's comfort level. Namely, the pillow 400 provides a "six-point" support to the user to thoroughly cover the user's head (A), neck (B), shoulders (C, C') and cheeks (D, D'), and the user can receive proper and sufficient pillow support no matter which rest position he/she adopts.

Having described the invention by the description and illustrations above, it should be understood that these are exemplary of the invention and are not to be considered as limiting. Accordingly, the invention is not to be considered as limited by the foregoing description, but includes any equivalents.

What is claimed is:

1. A pillow comprising:

a main pillow body, having three sections:

a head support section;

a pair of lateral support sections, each of said lateral support sections having a enlarging end and a substantially curved sidewall extending from a top portion of the lateral support section to said enlarging end; and a connecting end connecting to the head support section;

a neck support with a substantially flat sidewall, wherein the shape of the main pillow body resembles a reverse letter U, and the neck support is disposed at the opening of the reverse U-shaped main pillow body, wherein the head support section is at nearly the central portion of the main pillow body to provide support to the user's head, while the lateral support section extends from both sides of the head support section to provide support to the user's shoulders and cheeks through the enlarging ends that expand sideways no matter which rest position the user adopts, wherein the main pillow body and the neck support are connected through a sloped extended portion of the head support section to support the user's occipital bone, and wherein each of the enlarging end has a first edge and a second edge which are connected on one side of the enlarging end, gradually separated to extend around the enlarging end respectively, and ended at different positions on the other side of the enlarging end.

2. The pillow of claim 1, wherein the main pillow body and the neck support are separable.

3. The pillow of claim 2, the neck support is attached to the main pillow body using touch fastener, buttons, or the like.

4. The pillow of claim 1, wherein the pillow is filled with stuffing materials including down, fiberfill, feathers, granular materials, polyurethane foam, or the like.

5. The pillow of claim 4, wherein the height or thickness of the main pillow body and neck support is adjustable by adjusting the amount of the stuffing materials therein.

6. The pillow of claim 1, wherein the enlarging end that is configured to be thicker and longer is at a rear end of the lateral support section to provide support to the user's cheek and shoulder.

7. The pillow of claim 6, wherein the enlarging end is thicker and larger than the connecting end of the lateral support section, so that the stuffing materials are hardly moved from the enlarging end toward the connecting end to provide consistent support to the user's cheek and shoulder.

8. The pillow of claim 1, wherein the enlarging end is thicker and larger than the connecting end of the lateral support section, so that the stuffing materials are hardly moved from the enlarging end toward the connecting end to provide consistent support to the user's cheek and shoulder.

9. The pillow of claim 6, wherein the thickness enlarging end of the lateral support is adjustable by inserting or reducing the stuffing materials therein.

10. The pillow of claim 1, wherein the pillow provides support to cover six positions of the user, including head, neck, both sides of shoulders, and both sides of cheeks.

11. The pillow of claim 1, wherein the pillow is an orthopedic pillow.

12. The pillow of claim 1, wherein the neck support is of tear-drop shape.

* * * * *